US010162302B2

(12) United States Patent
Itabashi et al.

(10) Patent No.: US 10,162,302 B2
(45) Date of Patent: Dec. 25, 2018

(54) DEVELOPING CARTRIDGE HAVING CONTACT SURFACE

(71) Applicant: BROTHER KOGYO KABUSHIKI KAISHA, Nagoya-shi, Aichi-ken (JP)

(72) Inventors: Nao Itabashi, Nagoya (JP); Hideshi Nishiyama, Owariasahi (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/719,720

(22) Filed: Sep. 29, 2017

(65) Prior Publication Data

US 2018/0203408 A1 Jul. 19, 2018

(30) Foreign Application Priority Data

Jan. 16, 2017 (JP) ..... 2017-005066

(51) Int. Cl.
*G03G 15/08* (2006.01)
*G03G 21/16* (2006.01)
*G03G 21/18* (2006.01)

(52) U.S. Cl.
CPC ..... *G03G 21/1652* (2013.01); *G03G 15/0865* (2013.01); *G03G 21/1647* (2013.01);
(Continued)

(58) Field of Classification Search
CPC ..... G03G 15/0863; G03G 15/0865; G03G 21/1647; G03G 21/1652; G03G 21/1676;
(Continued)

(56) References Cited

U.S. PATENT DOCUMENTS 8,660,453 B2 * 2/2014 Oda ..... G03G 21/1878 399/90
2009/0196647 A1 8/2009 Nishimoto
(Continued)

FOREIGN PATENT DOCUMENTS

EP 0 895 140 A2 2/1999
JP 2003-195726 A 7/2003
(Continued)

OTHER PUBLICATIONS

Extended European Search Report issued in related European Patent Application No. 17193976.2, dated Feb. 3, 2018.
(Continued)

*Primary Examiner* — Sophia S Chen
(74) *Attorney, Agent, or Firm* — Merchant & Gould P.C.

(57) ABSTRACT

A developing cartridge includes a storage medium and a holder. The developing cartridge may be configured to move from a first position to a second position and further from the second position to a third position. The holder may include a first outer surface, a second outer surface, and an engaging portion. The second outer surface may have a guide surface out of contact with part of an image forming apparatus in a case where the developing cartridge is at the first position. The guide surface may contact with the part of the image forming apparatus in a case where the developing cartridge is at the second position. The engaging portion may be configured to allow the holder to engage with the image forming apparatus in a state where an electric contact surface contacts with an electric connector in a case where the developing cartridge is at the third position.

17 Claims, 15 Drawing Sheets

(52) U.S. Cl.
CPC ..... *G03G 21/1885* (2013.01); *G03G 15/0863* (2013.01); *G03G 2215/0697* (2013.01); *G03G 2221/1823* (2013.01)

(58) Field of Classification Search
CPC ..... G03G 21/1867; G03G 21/1875; G03G 21/1878; G03G 2215/0695; G03G 2215/0697; G03G 2221/163; G03G 2221/1823
USPC ..... 399/90
See application file for complete search history.

(56) References Cited

U.S. PATENT DOCUMENTS

| | | | |
|---|---|---|---|
| 2011/0064457 | A1 | 3/2011 | Okabe et al. |
| 2011/0129252 | A1 | 6/2011 | Oda et al. |
| 2013/0051849 | A1 | 2/2013 | Itabashi et al. |
| 2013/0183058 | A1 | 7/2013 | Won |
| 2015/0037059 | A1 | 2/2015 | Yang et al. |
| 2015/0098721 | A1* | 4/2015 | Buchanan ..... G03G 15/0865 399/90 |
| 2015/0261177 | A1 | 9/2015 | Moon et al. |

FOREIGN PATENT DOCUMENTS

| | | | |
|---|---|---|---|
| JP | 2007-017774 | A | 1/2007 |
| JP | 2008-242085 | A | 10/2008 |
| JP | 2009-211054 | A | 9/2009 |
| JP | 2011-059510 | A | 3/2011 |
| JP | 2011-118119 | A | 6/2011 |
| JP | 2013-054058 | A | 3/2013 |
| JP | 3196279 | U | 3/2015 |

OTHER PUBLICATIONS

International Search Report and the Written Opinion issued in related International Application No. PCT/JP2017/035545, dated Dec. 5, 2017.

* cited by examiner

DEVELOPING CARTRIDGE HAVING CONTACT SURFACE

CROSS REFERENCE TO RELATED APPLICATION

This application claims priority from Japanese Patent Application No. 2017-005066 filed Jan. 16, 2017. The entire content of the priority application is incorporated herein by reference.

TECHNICAL FIELD

The present disclosure relates to a developing cartridge.

BACKGROUND

Conventionally, an electrophotographic image forming apparatus such as a laser printer and an LED printer is known. A developing cartridge is used for the image forming apparatus. The developing cartridge includes a developing roller for supplying toner. The developing cartridge in the prior art is inserted into a drawer unit. The drawer unit includes a photosensitive drum. In a case where the developing cartridge is inserted into the drawer unit, the photosensitive drum and the developing roller face each other. Further, the drawer unit to which the developing cartridge is attached is accommodated inside the image forming apparatus.

Further, the developing cartridge described in the prior art is inserted into the drum unit. The drum unit includes a photosensitive drum. In a case where the developing cartridge is inserted into the drum unit, the photosensitive drum and the developing roller face each other. Further, the drum unit including the developing cartridge attached to the drum unit is attached to the image forming apparatus.

SUMMARY

Also, conventionally, a developing cartridge having a storage medium is also known. The storage medium is, for example, an IC chip. The storage medium includes an electric contact surface. The electric contact surface is in contact with an electrical connector positioned in the image forming apparatus or the drawer unit. However, in a case where the developing cartridge is inserted into the image forming apparatus or the drawer unit, the electrical connector and the electric contact surface rub against each other.

An object of the present disclosure is to provide a structure capable of reducing rubbing of the electric contact surface in a case where the developing cartridge is inserted.

According to one aspect, the disclosure provides a developing cartridge configured to be attached to an image forming apparatus. The developing cartridge may be configured to move relative to the image forming apparatus from a first position to a second position and further from the second position to a third position in a case where the developing cartridge is attached to the image forming apparatus. The developing cartridge includes a casing, a developing roller, a storage medium, and a holder. The casing may be configured to store therein developer. The developing roller may be rotatable about a first axis extending in a first direction. The developing roller may be positioned at one end portion of the casing in a second direction crossing the first direction. The storage medium may have an electric contact surface. The electric contact surface may be out of contact with an electric connector of the image forming apparatus in a case where the developing cartridge is at the first position and the second position. The electric contact surface may contact with the electric connector in a case where the developing cartridge is at the third position. The holder may be positioned at one end of the casing in the first direction. The holder may be movable relative to the casing in a third direction crossing the electric contact surface. The holder may include a first outer surface, a second outer surface, and an engaging portion. The first outer surface may be positioned at one end of the holder in the third direction and may hold the electric contact surface. The second outer surface may be positioned at another end of the holder in the third direction. A distance between the first outer surface and the second outer surface in the third direction may be a fixed distance. The second outer surface may have a guide surface out of contact with a portion of the image forming apparatus in a case where the developing cartridge is at the first position. The guide surface may contact with the portion of the image forming apparatus in a case where the developing cartridge is at the second position. The guide surface may be configured to guide movement of the holder relative to the casing in the third direction in a state where the guide surface contacts with the portion of the image forming apparatus. The engaging portion may be configured to allow the holder to engage with the image forming apparatus in a state where the electric contact surface contacts with the electric connector in a case where the developing cartridge is at the third position.

BRIEF DESCRIPTION OF THE DRAWINGS

The particular features and advantages of the disclosure will become apparent from the following description taken in connection with the accompanying drawings, in which.

DETAILED DESCRIPTION

Hereinafter, an embodiment of the present disclosure will be described with reference to the drawings.

In the following description, the direction in which the rotating shaft of the developing roller extends is referred to as a "first direction". Also, a direction intersecting with the first direction (in the embodiment, a direction of insertion of the developing cartridge to the image forming apparatus) is referred to as a "second direction". Also, a direction intersecting with the electric contact surface is referred to as a "third direction". The first direction and the second direction are preferably orthogonal to each other. The second direction and the third direction intersect with each other, preferably orthogonal to each other. The third direction and the first direction intersect with each other, preferably orthogonal to each other.

1. First Embodiment

<1-1. Overall Configuration of Developing Cartridge>

Figure 1:
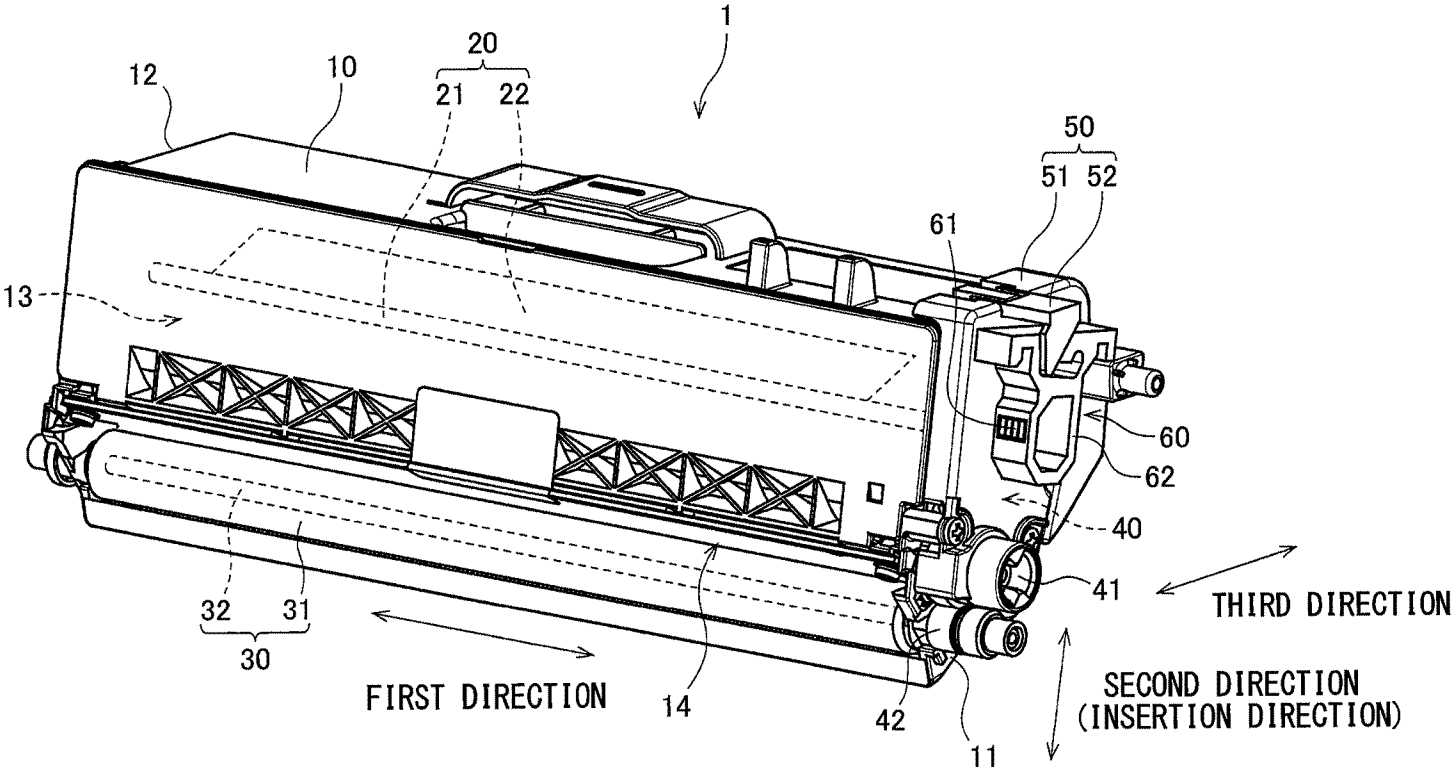
FIG. 1 is a perspective view of a developing cartridge according to a first embodiment.
Figure 2:
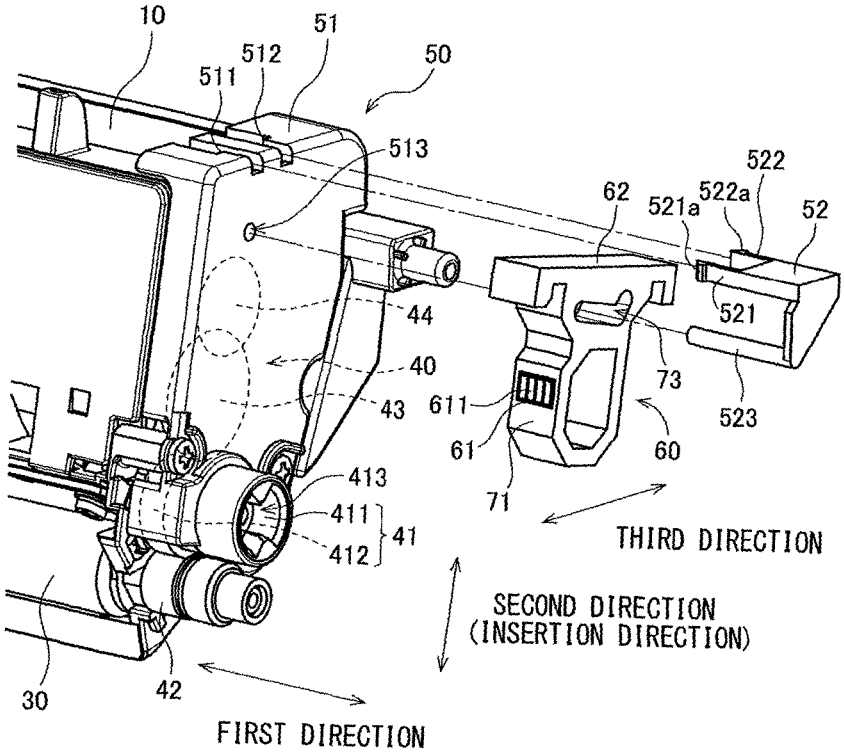
FIG. 2 is a partially exploded perspective view of the developing cartridge according to the first embodiment.

FIG. 1 is a perspective view of a developing cartridge 1 of the first embodiment. FIG. 2 is a partially exploded perspective view of the developing cartridge 1. The developing cartridge 1 is a unit that is used in an electrophotographic image forming apparatus (for example, a laser printer or an LED printer) and supplies developer (for example, toner) to a photosensitive drum. For example, the developing cartridge 1 is attached to a drawer unit of the image forming apparatus. In a case where the developing cartridge 1 is exchanged, the drawer unit is pulled out from the front side of the image forming apparatus. Further, the developing cartridge 1 is inserted into each of a plurality of slots of the drawer unit. A photosensitive drum is positioned in each of the plurality of slots.

However, the developing cartridge 1 may be attached to a main body portion of the image forming apparatus. In that case, the developing cartridge 1 is inserted into a plurality of slots of the image forming apparatus. A photosensitive drum may be positioned in each of the plurality of slots. Further, the developing cartridge 1 may be attached to a drum unit that is attachable to and detachable from the image forming apparatus. In that case, the drum unit includes a photosensitive drum. Further, the developing cartridge 1 is inserted into the slot of the image forming apparatus in a state of being attached to the drum unit.

As illustrated in FIG. 1, the developing cartridge 1 of the present embodiment includes a casing 10, an agitator 20, a developing roller 30, a gear unit 40, a cover 50, and an IC chip assembly 60.

The casing 10 is a housing configured to storing the developer. The casing 10 includes a first end surface 11 and a second end surface 12. The first end surface 11 is an outer surface positioned at one end of the casing 10 in the first direction. The second end surface 12 is an outer surface positioned at the other end of the casing 10 in the first direction. The casing 10 extends in the first direction between the first end surface 11 and the second end surface 12. The gear unit 40, the cover 50, and the IC chip assembly 60 are positioned at the first end surface 11. A storage chamber 13 is positioned inside the casing 10. The developer is stored in the storage chamber 13. The casing 10 has an opening 14. The opening 14 is positioned at one end portion of the casing 10 in the second direction. The storage chamber 13 and the outside communicate with each other via the opening portion 14.

The agitator 20 includes an agitator shaft 21 and an agitation blade 22. The agitator shaft 21 is rotatable about a rotation axis extending in the first direction. The agitation blade 22 expands radially outward from the agitator shaft 21. At least a portion of the agitator shaft 21 and the agitation blade 22 are positioned in the storage chamber 13. One end portion of the agitator shaft 21 in the first direction is fixed to the agitator gear 44 to be described later to be relatively non-rotatable. Therefore, the agitator shaft 21 and the agitation blade 22 rotate together with the agitator gear 44. As the agitation blade 22 rotates, the developer in the storage chamber 13 is agitated.

The developing roller 30 is a roller that is rotatable about a rotation axis (first axis) extending in the first direction. The developing roller 30 is positioned at the opening 14 of the casing 10. That is, the developing roller 30 is positioned at one end of the casing 10 in the second direction. The developing roller 30 of the present embodiment includes a developing roller main body 31 and a developing roller shaft 32. The developing roller main body 31 is a cylindrical member extending in the first direction. As the material of the developing roller main body 31, for example, elastic rubber is used. The developing roller shaft 32 is a columnar member penetrating the developing roller main body 31 in the first direction. As the material of the developing roller shaft 32, a metal or a resin having conductivity is used. The developing roller main body 31 is fixed to the developing roller shaft 32 to be relatively non-rotatable.

A developing roller gear 42 is mounted to one end portion of the developing roller shaft 32 in the first direction. More specifically, one end portion of the developing roller shaft 32 in the first direction is fixed to the developing roller gear 42 to be described later to be relatively non-rotatable. Therefore, in a case where the developing roller gear 42 rotates, the developing roller shaft 32 also rotates, and the developing roller main body 31 also rotates together with the developing roller shaft 32.

The developing roller shaft 32 may not penetrate the developing roller main body 31 in the first direction. For example, a pair of developing roller shafts 32 may extend in the first direction from both ends of the developing roller main body 31 in the first direction.

Further, the developing cartridge 1 includes a supply roller (not illustrated). The supply roller is positioned between the developing roller 30 and the storage chamber 13. The supply roller is also rotatable about a rotation axis extending in the first direction. In a case where the developing cartridge 1 receives the driving force, the developer is supplied from the storage chamber 13 in the casing 10 to the outer circumferential surface of the developing roller 30 via the supply roller. At that time, the developer is frictionally charged between the supply roller and the developing roller 30. Meanwhile, a bias voltage is applied to the developing roller shaft 32 of the developing roller 30. Therefore, the developer is attracted to the outer circumferential surface of the developing roller main body 31, by the electrostatic force between the developing roller shaft 32 and the developer.

Further, the developing cartridge 1 includes a layer thickness regulating blade (not illustrated). The layer thickness regulating blade shapes the developer supplied to the outer circumferential surface of the developing roller main body 31 to a certain thickness. Thereafter, the developer on the outer circumferential surface of the developing roller main body 31 is supplied to the photosensitive drum in the drawer unit. At this time, the developer moves from the developing roller main body 31 to the photosensitive drum in accordance with the electrostatic latent image formed on the outer circumferential surface of the photosensitive drum. As a result, the electrostatic latent image is visualized on the outer circumferential surface of the photosensitive drum.

The gear unit 40 is positioned at the first end surface 11 of the casing 10. As illustrated in FIG. 2, the gear unit 40 includes a coupling 41, a developing roller gear 42, an idle gear 43, and an agitator gear 44. In FIG. 2, a plurality of gear teeth of each gear is not illustrated.

The coupling 41 is a gear which initially receives the driving force supplied from the image forming apparatus. The coupling 41 is rotatable about the rotation axis extending in the first direction. The coupling 41 includes a coupling portion 411 and a coupling gear 412. The coupling portion 411 and the coupling gear 412 are integrally formed of, for example, resin. The coupling portion 411 has a fastening hole 413 that is recessed in the first direction. Further, a plurality of gear teeth is positioned at the outer circumferential portion of the coupling gear 412 at equal intervals over the entire circumference.

In a case where the drawer unit to which the developing cartridge 1 is attached is accommodated in the image forming apparatus, the driving shaft of the image forming apparatus is inserted into the fastening hole 413 of the coupling portion 411. Therefore, the drive shaft and the coupling portion 411 are connected to be relatively non-rotatable. Therefore, in a case where the drive shaft rotates, the coupling portion 411 rotates, and the coupling gear 412 and the coupling portion 411 also rotate.

The developing roller gear 42 is a gear for rotating the developing roller 30. The developing roller gear 42 is rotatable about the rotation axis extending in the first direction. A plurality of gear teeth is positioned at the outer circumferential portion of the developing roller gear 42 at equal intervals over the entire circumference. A part of the plurality of gear teeth of the coupling gear 412 and a portion of the plurality of gear teeth of the developing roller gear 42 mesh with each other. Further, the developing roller gear 42 is fixed to the end portion of the developing roller shaft 32 in the first direction to be relatively non-rotatable. Therefore, in a case where the coupling gear 412 rotates, the developing roller gear 42 rotates, and the developing roller 30 rotates together with the developing roller gear 42.

The idle gear 43 is a gear for transmitting the rotation of the coupling gear 412 to the agitator gear 44. The idle gear 43 is rotatable about the rotation axis extending in the first direction. The idle gear 43 includes a large-diameter gear unit and a small-diameter gear unit arranged in the first direction. The small-diameter gear unit is positioned between the large-diameter gear unit and the first end surface 11 of the casing 10. In other words, the large-diameter gear unit is farther from the first end surface 11 than from the small-diameter gear unit. The diameter of the tooth tip circle of the small-diameter gear unit is smaller than the diameter of the tooth tip circle of the large-diameter gear unit. The large-diameter gear unit and the small-diameter gear unit are integrally formed of, for example, resin.

A plurality of gear teeth is provided at the outer circumferential portions of the large-diameter gear unit and the small-diameter gear unit at equal intervals over the entire circumference, respectively. The number of the gear teeth of the small-diameter gear unit is smaller than the number of the gear teeth of the large-diameter gear unit. A portion of the plurality of gear teeth of the coupling gear 412 and a portion of the plurality of gear teeth of the large-diameter gear unit mesh with each other. Further, a portion of the plurality of gear teeth of the small-diameter gear unit and a portion of the plurality of gear teeth of the agitator gear 44 mesh with each other. In a case where the coupling gear 412 rotates, the large-diameter gear unit rotates, and the small-diameter gear unit rotates together with the large-diameter gear unit. With rotation of the small-diameter gear unit, the agitator gear 44 also rotates.

The agitator gear 44 is a gear for rotating the agitator 20 in the storage chamber 13. The agitator gear 44 is rotatable about the rotation axis extending in the first direction. A plurality of gear teeth is positioned at the outer circumferential portion of the agitator gear 44, at equal intervals over the entire circumference. As described above, a part of the plurality of gear teeth of the small-diameter gear unit and a part of the plurality of gear teeth of the agitator gear 44 mesh with each other. Further, the agitator gear 44 is fixed to one end of the agitator shaft 21 in the first direction to be relatively non-rotatable. Therefore, in a case where power is transmitted from the coupling 41 to the agitator gear 44 via the idle gear 43, the agitator gear 44 rotates, and the agitator 20 also rotates together with the agitator gear 44.

The cover 50 includes a gear cover 51 and a holder cover 52. The gear cover 51 is fixed to the first end surface 11 of the casing 10 by, for example, screwing. At least some parts of the coupling gear 412, the developing roller gear 42, the idle gear 43, and the agitator gear 44 are positioned between the first end surface 11 and the gear cover 51. The fastening hole 413 of the coupling portion 411 is exposed to the outside of the gear cover 51. The holder cover 52 is fixed to the gear cover 51.

The holder cover 52 includes a first arm portion 521, a second arm portion 522, and a boss 523. Each of the first arm portion 521, the second arm portion 522, and the boss 523 extends in the first direction from the holder cover 52 toward the gear cover 51. A first claw 521*a* protruding in the direction intersecting with the first direction is positioned at the tip of the first arm portion 521. A second claw 522*a* protruding in a direction intersecting with the first direction is positioned at the tip of the second arm portion 522. The gear cover 51 has a first groove 511, a second groove 512, and a hole 513. The first claw 521*a* engages with the first groove 511. The second claw 522*a* engages with the second groove 512. The boss 523 is inserted into the hole 513. As a result, the holder cover 52 is fixed to the gear cover 51. That is, the holder cover 52 is fixed to the first end surface 11 of the casing 10 via the gear cover 51.

However, the gear cover 51 and the holder cover 52 may be formed of a single member.

<1-2. IC Chip Assembly>

Figure 3:
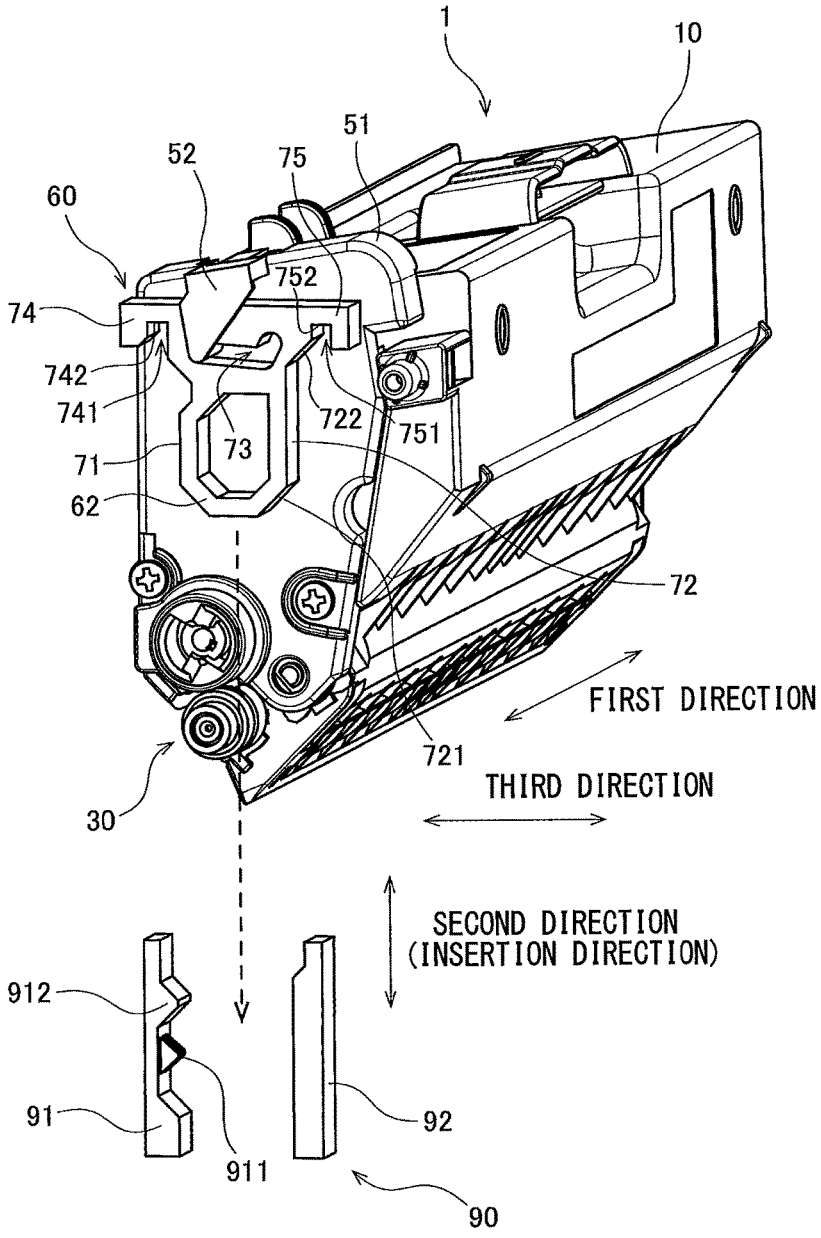
FIG. 3 is a perspective view of some parts of a drawer unit and the developing cartridge according to the first embodiment.

An IC chip assembly 60 is a unit including an IC chip 61 which is an example of a storage medium. The IC chip assembly 60 is positioned at one end of the casing 10 in the first direction. At least a portion of the IC chip assembly 60 is positioned between the gear cover 51 and the holder cover 52. FIG. 3 is a perspective view of some parts of the drawer unit 90 and the developing cartridge 1. As illustrated in FIG. 3, the drawer unit 90 includes a first guide plate 91 and a second guide plate 92. In a case where the developing cartridge 1 is inserted into the drawer unit 90, the IC chip assembly 60 is inserted between the first guide plate 91 and the second guide plate 92.

As illustrated in FIGS. 1 to 3, the IC chip assembly 60 includes an IC chip 61 and a holder 62.

The IC chip 61 is a plate-like storage medium. Various types of information on the developing cartridge 1 are stored in the IC chip 61. As illustrated in FIG. 2, the IC chip 61 includes an electric contact surface 611. The electric contact surface 611 is made of metal which is an electrical conductor. Meanwhile, as illustrated in FIG. 3, the first guide plate 91 includes an electrical connector 911. The electrical connector 911 is an electrical conductor that can contact with the electric contact surface 611. In a case where the developing cartridge 1 is attached to the drawer unit 90, the electric contact surface 611 of the IC chip 61 contacts with the electrical connector 911. Thus, the electric contact surface 611 and the electrical connector 911 are electrically connected to each other. As a result, the image forming apparatus can perform at least one of reading of information from the IC chip 61 and writing of information to the IC chip 61.

The holder 62 includes a first outer surface 71 and a second outer surface 72. The first outer surface 71 is positioned at one end portion of the holder 62 in the third direction. The second outer surface 72 is positioned at the other end portion of the holder 62 in the third direction. The first outer surface 71 and the second outer surface 72 are spaced apart from each other in the third direction. The IC chip 61 is held on the first outer surface 71. For example, the IC chip 61 is fitted into a recess positioned in the first outer surface 71. However, the IC chip 61 may be fixed to the first outer surface 71 with an adhesive. The holder 62 and the electric contact surface 611 of the IC chip 61 may be movable together. The holder 62 is integrally formed of, for example, resin. The distance in the third direction between the first outer surface 71 and the second outer surface 72 is a fixed distance.

The holder 62 has a through-hole 73. The through-hole 73 penetrates the holder 62 in the first direction. A boss 523 of the holder cover 52 is inserted into the through-hole 73. The shape of the boss 523 may be a cylinder or a polygonal column.

The size (inner dimension) of the through-hole 73 in the second direction is greater than the size (outer dimension) of the boss 523 in the second direction. Therefore, the holder 62 is movable relative to the boss 523 in the second direction. That is, the holder 62 is movable relative to the casing 10 and the cover 50 in the second direction. In a case where the holder 62 moves in the second direction, the IC chip 61 having the electric contact surface 611 moves together with the holder 62 in the second direction.

Further, the size (inner dimension) of the through-hole 73 in the third direction is greater than the size (outer dimension) of the boss 523 in the third direction. Therefore, the holder 62 is movable relative to the boss 523 in the third direction. That is, the holder 62 is movable relative to the casing 10 and the cover 50 in the third direction. In a case where the holder 62 moves in the third direction, the IC chip 61 having the electric contact surface 611 also moves together with the holder 62 in the third direction.

Further, the holder 62 may be movable in the first direction between the gear cover 51 and the holder cover 52.

The holder cover 52 may have a plurality of bosses 523. In that case, the holder 62 may have one or a plurality of through-holes 73 into which the plurality of bosses 523 are inserted. The plurality of bosses 523 may be inserted into a single through-hole 73. The holder 62 may have a recess into which the boss 523 is inserted, in place of the through-hole 73. Further, the gear cover 51 may have a boss extending in the first direction toward the holder cover 52. Further, the boss of the gear cover 51 may be inserted into the through-hole 73 or the recess of the holder 62.

Further, the holder cover 52 may have a through-hole or a recess. Further, the holder 62 may have a boss extending in the first direction toward the holder cover 52. Further, the boss of the holder 62 may be inserted into the through-hole or the recess of the holder cover 52. Further, the gear cover 51 may have a through-hole or a recess. Further, the holder 62 may have a boss extending in the first direction toward the gear cover 51. Further, the boss of the holder 62 may be inserted into the through-hole or the recess of the gear cover 51.

The second outer surface 72 includes a first guide surface 721 and a second guide surface 722. The first guide surface 721 is positioned closer to the developing roller 30 than the electric contact surface 611 of the IC chip 61 is to the developing roller 30 in the second direction. The first guide surface 721 is an inclined surface inclined relative to the second direction to approach the first outer surface 71 toward the developing roller 30. The second guide surface 722 is positioned farther from the developing roller 30 than the electric contact surface 611 of the IC chip 61 is from the developing roller 30 in the second direction. The second guide surface 722 is an inclined surface inclined relative to the second direction to approach the first outer surface 71 toward the developing roller 30.

In a case where the developing cartridge 1 is inserted into the drawer unit 90, the first guide surface 721 contacts with the second guide plate 92, and thereafter, the second guide surface 722 contacts with the second guide plate 92. As a result, the position of the holder 62 in the third direction relative to the casing 10 changes. Specifically, the holder 62 moves toward the first guide plate 91 in the third direction. Detailed movement of the holder 62 at the time of insertion of the developing cartridge 1 will be described later.

The holder 62 includes a first engaging portion 74 and a second engaging portion 75.

The first engaging portion 74 is positioned farther from the second outer surface 72 than the first outer surface 71 is from the second outer surface 72 in the third direction. Further, the first engaging portion 74 is positioned farther from the developing roller 30 than the electric contact surface 611 of the IC chip 61 is from the developing roller 30 in the second direction. Further, the first engaging portion 74 is positioned farther from the developing roller 30 than the second guide surface 722 is from the developing roller 30 in the second direction. The first engaging portion 74 of the present embodiment is a hook. The first engaging portion 74 is caught by the first guide plate 91 of the image forming apparatus.

Further, the first engaging portion 74 of the present embodiment has a first groove 741. The first groove 741 is recessed on the facing surface of the developing roller 30 and the first engaging portion 74 in the second direction, in a direction away from the developing roller 30. The first guide plate 91 is fitted to the first groove 741. Further, the first engaging portion 74 includes a first stopper surface 742. In the present embodiment, a portion of the surface constituting the first groove 741 is the first stopper surface 742. The first stopper surface 742 contacts with the first guide plate 91 in the second direction.

The second engaging portion 75 is positioned farther from the first outer surface 71 than the second outer surface 72 is from the first outer surface 71 in the third direction. Further, the second engaging portion 75 is positioned farther from the developing roller 30 than the electric contact surface 611 of the IC chip 61 is from the developing roller 30 in the second direction. Further, the second engaging portion 75 is positioned farther from the developing roller 30 than the second guide surface 722 is from the developing roller 30 in the second direction. The second engaging portion 75 of the present embodiment is a hook. The second engaging portion 75 hooks the second guide plate 92 of the image forming apparatus.

Further, the second engaging portion 75 of the present embodiment has a second groove 751. The second groove 751 is recessed in a direction away from the developing roller 30 on the facing surface of the developing roller 30 and the second engaging portion 75 in the second direction. The second guide plate 92 is fitted to the second groove 751. Further, the second engaging portion 75 includes a second stopper surface 752. In the present embodiment, a portion of the surface constituting the second groove 751 is the second stopper surface 752. The second stopper surface 752 contacts with the second guide plate 92 in the second direction.

Further, in the present embodiment, the first outer surface 71, the second outer surface 72, the first engaging portion 74, and the second engaging portion 75 are positioned at the same position in the first direction. In this way, the thickness of the holder 62 in the first direction can be made thinner. However, some parts of the first outer surface 71, the second outer surface 72, the first engaging portion 74, and the second engaging portion 75 may be positioned at different positions in the first direction.

<1-3. Inserting Operation>

Figure 4:
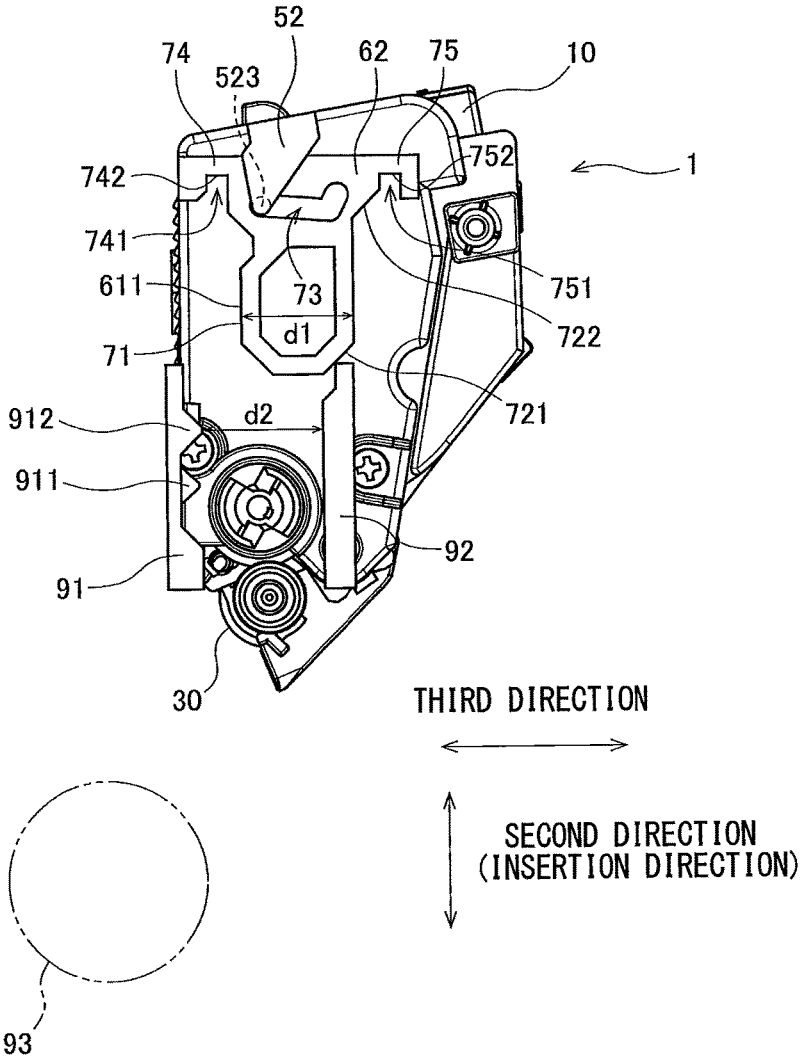
FIG. 4 illustrates an inserting operation according to the first embodiment.
Figure 5:
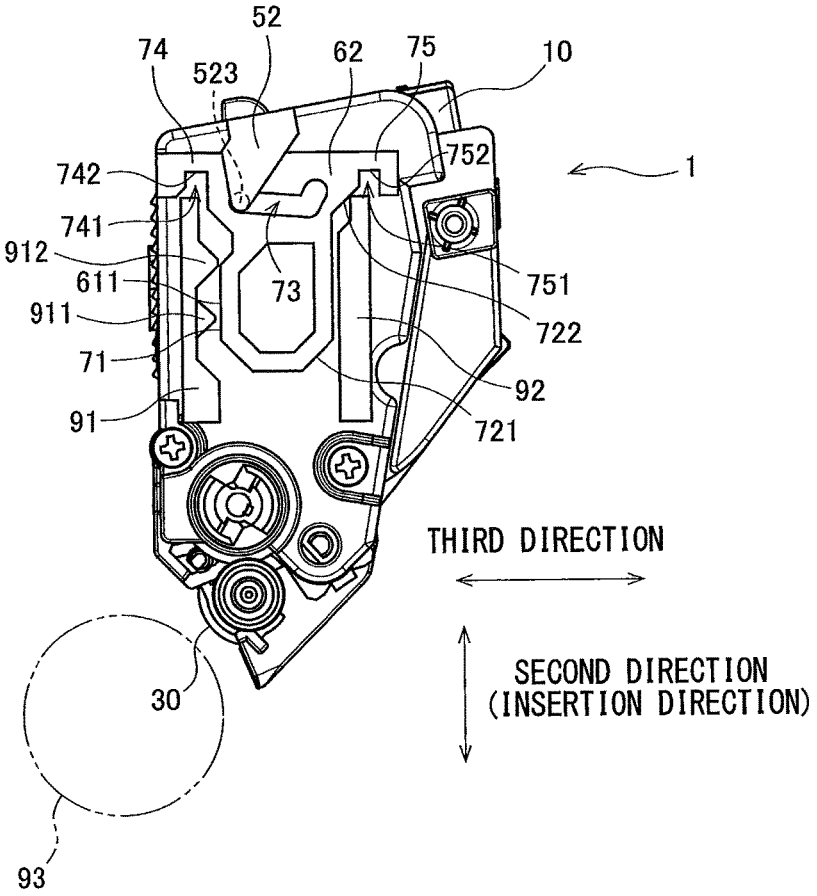
FIG. 5 illustrates the inserting operation according to the first embodiment.
Figure 6:
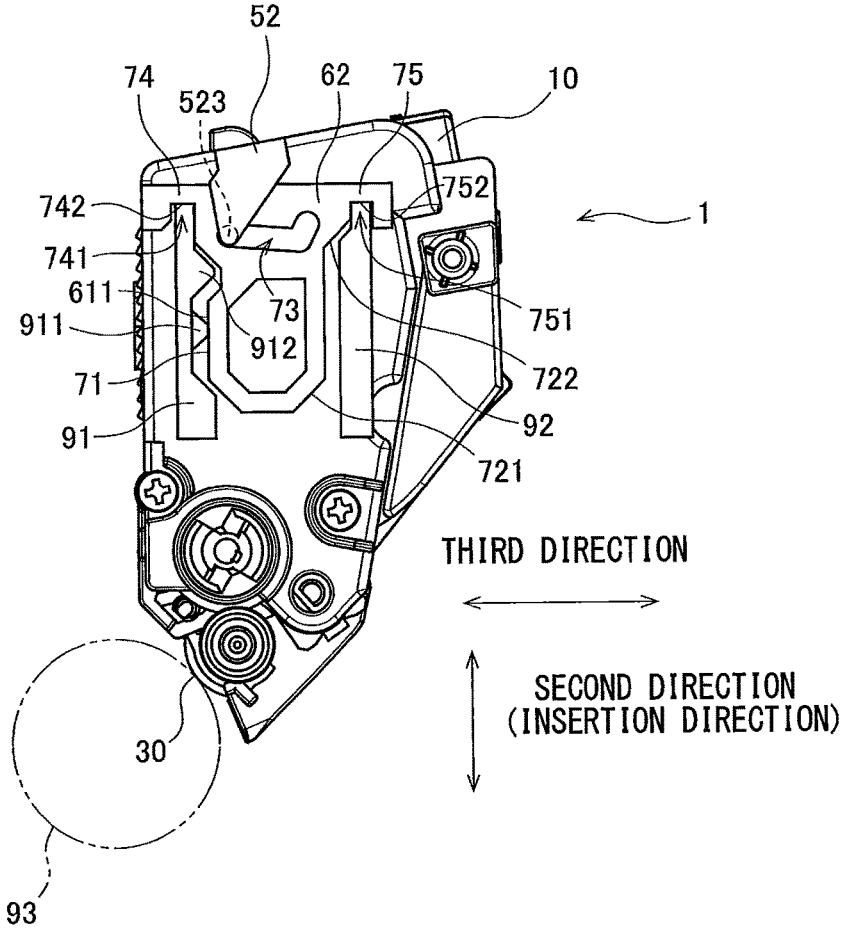
FIG. 6 illustrates the inserting operation according to the first embodiment.

Subsequently, the inserting operation of the developing cartridge 1 to the drawer unit 90 will be described. FIGS. 4 to 6 are views illustrating a state in a case where the developing cartridge 1 is inserted into the drawer unit 90.

As described above, the drawer unit 90 includes a first guide plate 91 and a second guide plate 92. The first guide plate 91 and the second guide plate 92 face each other at an interval in the third direction. The first guide plate 91 includes an electrical connector 911. The electrical connector 911 protrudes from the surface of the first guide plate 91 toward the second guide plate 92 in the third direction. The electrical connector 911 is electrically connected to the control unit in the image forming apparatus.

Further, the first guide plate 91 includes a guide protrusion 912. The guide protrusion 912 is positioned farther from the photosensitive drum 93 than the electrical connector 911 is from the photosensitive drum 93 in the second direction. The guide protrusion 912 protrudes from the surface of the first guide plate 91 toward the second guide plate 92.

In a case where the developing cartridge 1 is attached to the drawer unit 90, first, as illustrated in FIG. 4, the developing cartridge 1 is positioned at the first position relative to the drawer unit 90. At the first position, the first engaging portion 74 does not engage with the first guide plate 91 yet. The second engaging portion 75 does not engage with the second guide plate 92 yet. Further, the second guide surface 722 does not contact with the second guide plate 92 yet. In addition, the electric contact surface 611 of the IC chip 61 does not contact with the electrical connector 911 yet.

At the first position, the first guide surface 721 of the holder 62 contacts with the second guide plate 92. In a case where the developing cartridge 1 is inserted from the first position toward the photosensitive drum 93, the holder 62 receives a pressure in the second direction from the boss 523 toward the photosensitive drum 93. At this time, due to the contact between the first guide surface 721 and the second guide plate 92, the position of the holder 62 in the third direction relative to the casing 10 changes. Specifically, the holder 62 moves toward the first guide plate 91 in the third direction. As a result, the holder 62 is guided between the first guide plate 91 and the second guide plate 92.

The length d1 in the third direction between the first outer surface 71 and the second outer surface 72 of the holder 62 is shorter than the length d2 in the third direction between the top of the guide protrusion 912 of the first guide plate 91 and the second guide plate 92. Therefore, the first outer surface 71 and the second outer surface 72 of the holder 62 pass between the guide protrusion 912 and the second guide plate 92. That is, the IC chip 61 including the electric contact surface 611 passes through the guide protrusion 912.

Subsequently, as illustrated in FIG. 5, the developing cartridge 1 is positioned at the second position relative to the drawer unit 90. At the second position, the first engaging portion 74 does not engage with the first guide plate 91 yet. The second engaging portion 75 does not engage with the second guide plate 92 yet. Further, the electric contact surface 611 of the IC chip 61 does not contact with the electrical connector 911 yet.

At the second position, the second guide surface 722 of the holder 62 contacts with the second guide plate 92. In a case where the developing cartridge 1 is further inserted from the second position toward the photosensitive drum 93, the holder 62 receives the pressure in the second direction from the boss 523 toward the photosensitive drum 93. At this time, due to the contact between the second guide surface 722 and the second guide plate 92, the position of the holder 62 in the third direction relative to the casing 10 further changes. Specifically, the holder 62 further moves in the third direction toward the first guide plate 91.

As a result, as illustrated in FIG. 6, the developing cartridge 1 is positioned at the third position relative to the drawer unit 90. In a case where the developing cartridge 1 moves from the second position to the third position, the electric contact surface 611 first contacts with the electrical connector 911. At this time, the first engaging portion 74 may not engage with the first guide plate 91 yet, and the second engaging portion 75 may not engage with the second guide plate 92 yet. Further, after the electric contact surface 611 contacts with the electrical connector 911, the first engaging portion 74 engages with the first guide plate 91, and the second engaging portion 75 engages with the second guide plate 92.

At the third position, the first engaging portion 74 of the holder 62 engages with the first guide plate 91. Specifically, the first guide plate 91 is fitted to the first groove 741 of the first engaging portion 74. Further, the first stopper surface 742 of the first engaging portion 74 contacts with the first guide plate 91. As a result, the position of the first engaging portion 74 in the second direction relative to the first guide plate 91 is fixed. Further, the position of the first engaging portion 74 in the third direction relative to the first guide plate 91 is also restricted.

Further, at the third position, the second engaging portion 75 of the holder 62 engages with the second guide plate 92. Specifically, the second guide plate 92 is fitted to the second groove 751 of the second engaging portion 75. Further, the second stopper surface 752 of the second engaging portion 75 contacts with the second guide plate 92. As a result, the position of the second engaging portion 75 in the second direction relative to the second guide plate 92 is fixed. Further, the position of the second engaging portion 75 in the third direction relative to the second guide plate 92 is also restricted.

That is, since the first engaging portion 74 engages with the first guide plate 91 and the second engaging portion 75 engages with the second guide plate 92, the position of the holder 62 in the second direction relative to the drawer unit 90 is fixed. Also, the position of the holder 62 in the third direction relative to the drawer unit 90 is also limited. Further, at the third position, the electric contact surface 611 of the IC chip 61 contacts with the electrical connector 911. The position of the holder 62 in the third direction is fixed by interposing the holder 62 between the electrical connector 911 and the second guide plate 92. As a result, the control unit of the image forming apparatus can perform at least one of reading of information from the IC chip 61 and writing of information to the IC chip 61.

In this way, in the present embodiment, in a case where the developing cartridge 1 is inserted into the drawer unit 90, the first guide surface 721 and the second guide surface 722 of the holder 62 contact with the second guide plate 92 which is a portion of the image forming apparatus. Thus, the holder 62 moves in the third direction relative to the casing 10. As a result, the electric contact surface 611 of the IC chip 61 contacts with the electrical connector 911. Thus, the developing cartridge 1 can be inserted into the drawer unit 90, while suppressing rubbing of the electric contact surface 611.

<1-4. Pivoting Operation>

Figure 7:
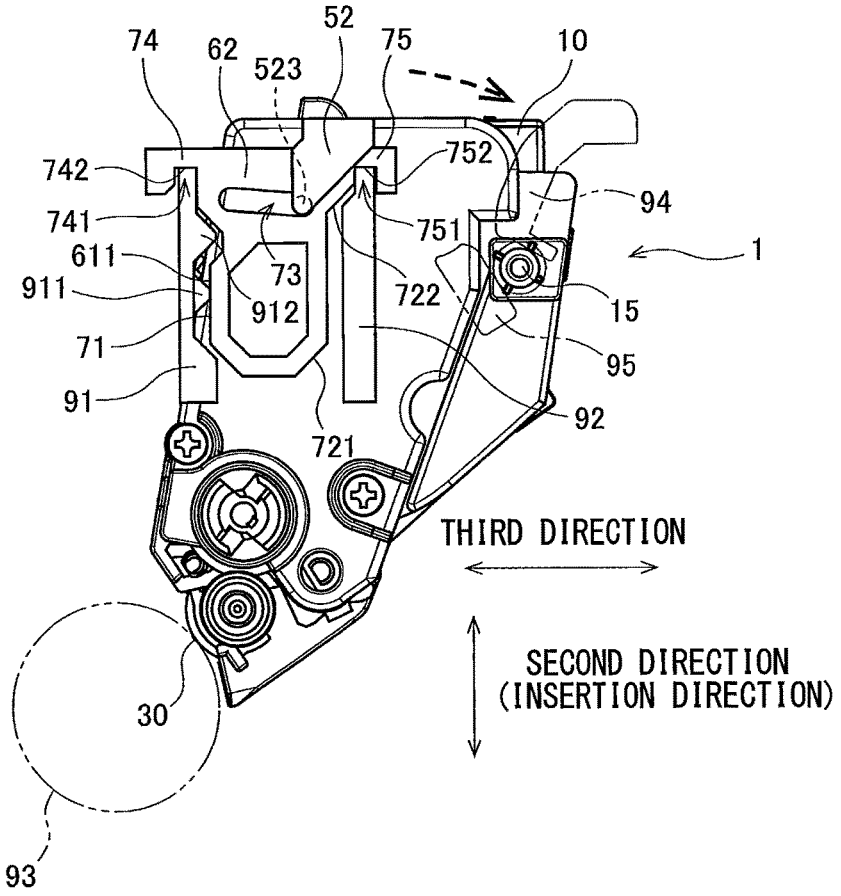
FIG. 7 illustrates a pivoting operation according to the first embodiment.

Subsequently, the pivoting operation of the casing 10 after inserting the developing cartridge 1 into the drawer unit 90 will be described. FIG. 7 is a view illustrating the state of the pivoting operation.

As illustrated in FIG. 7, the casing 10 includes a protrusion 15. The protrusion 15 has a columnar shape. The protrusion 15 extends from the first end surface 11 of the casing 10 in the first direction. Further, the protrusion 15 is not covered by the cover 50 but is exposed to the outside.

After inserting the developing cartridge 1 into the drawer unit 90, the casing 10 and the cover 50 pivot about the developing roller 30 relative to the drawer unit 90. Specifically, the casing 10 is inclined in the direction relative to the drawer unit 90, as indicated by a broken line arrow in FIG. 7. At this time, the protrusion 15 of the casing 10 contacts with the pressing member 94 of the drawer unit 90. The pressing member 94 presses the protrusion 15 toward the photosensitive drum 93. As a result, the developing roller 30 is pressed against the photosensitive drum 93.

The first engaging portion 74 of the holder 62 is kept in a state where the first engaging portion 74 of the holder 62 engages with the first guide plate 91 before and after the pivoting operation. Further, before and after the pivoting operation, the second engaging portion 75 of the holder 62 is kept in a state where the second engaging portion 75 of the holder 62 engages with the second guide plate 92. Therefore, the position of the holder 62 relative to the drawer unit 90 does not change. Therefore, the electrical connector 911 and the electric contact surface 611 are kept in the contact state. As a result, the rubbing of the electric contact surface 611 at the time of the pivoting operation is reduced. The boss 523 of the holder cover 52 moves inside the through-hole 73 in the third direction. Thus, the casing 10 and the cover 50 can move relative to the holder 62 in the third direction.

In a state after pivoting, it is preferable that the boss 523 and the holder 62 are not contact with each other. When the boss 523 and the holder 62 are not in contact with each other, the holder 62 is not in contact with the casing 10 and the cover 50. Therefore, during the execution of the printing process in the image forming apparatus, vibration is less likely to be transmitted from the driving unit such as the gear unit 40 to the IC chip assembly 60. Thus, the contact state between the electric contact surface 611 and the electrical connector 911 can be more satisfactorily maintained.

<1-5. Separating Operation>

Figure 8:
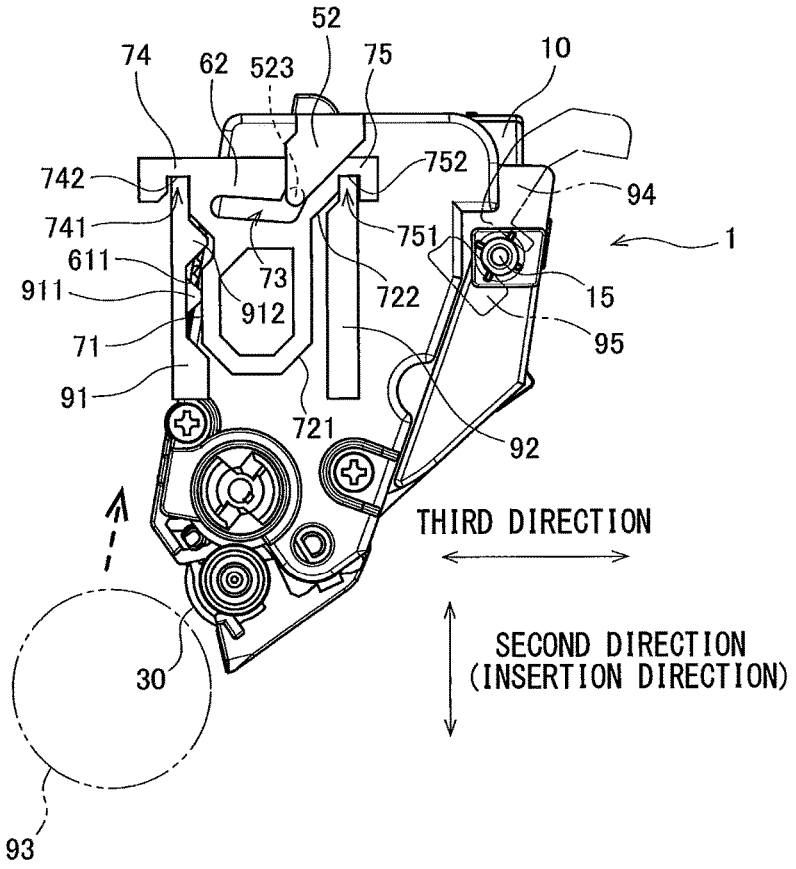
FIG. 8 illustrates a separating operation according to the first embodiment.

After the inserting operation and the pivoting operation described above are completed, the image forming apparatus can perform a so-called "separating operation" of temporarily separating the developing roller 30 from the photosensitive drum 93. Hereinafter, the separating operation will be described. FIG. 8 is a diagram illustrating a state in a case where the separating operation is performed.

At the time of the separating operation, a lever (not illustrated) of the drawer unit 90 is pushed by the driving force from the image forming apparatus. Then, the separating member 95 of the drawer unit 90 moves toward the pressing member 94 in the second direction. As a result, the separating member 95 contacts with the protrusion 15 and presses the protrusion 15 in a direction away from the photosensitive drum 93 against the pressure of the pressing member 94. As a result, the casing 10, the developing roller 30, and the cover 50 of the developing cartridge 1 move in the second direction as indicated by broken line arrow in FIG. 8. Thus, the developing roller 30 and the photosensitive drum 93 are in a separated state where the developing roller 30 and the photosensitive drum 93 are separated from each other.

Before and after the separating operation, the first engaging portion 74 of the holder 62 is kept in a state where the first engaging portion 74 of the holder 62 engages with the first guide plate 91. Further, before and after the separating operation, the second engaging portion 75 of the holder 62 is kept in a state where the second engaging portion 75 of the holder 62 engages with the second guide plate 92. Therefore, the position of the holder 62 relative to the drawer unit 90 does not change. Therefore, the electrical connector 911 and the electric contact surface 611 are kept in a contact state. In this state, since the protrusion 15 moves, the casing 10 and the developing roller 30 move with respect to the photosensitive drum 93. Further, since the electrical connector 911 and the electric contact surface 611 are kept in the contact state, the rubbing of the electric contact surface 611 at the time of the separating operation is reduced. The boss 523 of the holder cover 52 moves inside the through-hole 73 in the second direction. Thus, the casing 10 and the cover 50 can move relative to the holder 62 in the second direction.

Further, in the present embodiment, the insertion direction of the developing cartridge 1 into the drawer unit 90 and the direction (separation direction) in which the developing roller 30 is separated from the photosensitive drum 93 at the time of the separating operation were both in the second direction. However, the insertion direction and the separation direction may be different directions. The insertion direction and the separation direction may be any direction as long as each of them is a direction intersecting with the first direction.

2. Second Embodiment

<2-1. Configuration of Developing Cartridge>

Subsequently, the developing cartridge 1 of the second embodiment will be described. The second embodiment is different from the first embodiment in the shapes of the cover, the holder of the IC chip assembly, the first guide plate, and the second guide plate. Hereinafter, parts other than the cover 50 and the holder 62 are denoted by the same reference numerals as those in the first embodiment, and the repeated description will be omitted.

Figure 9:
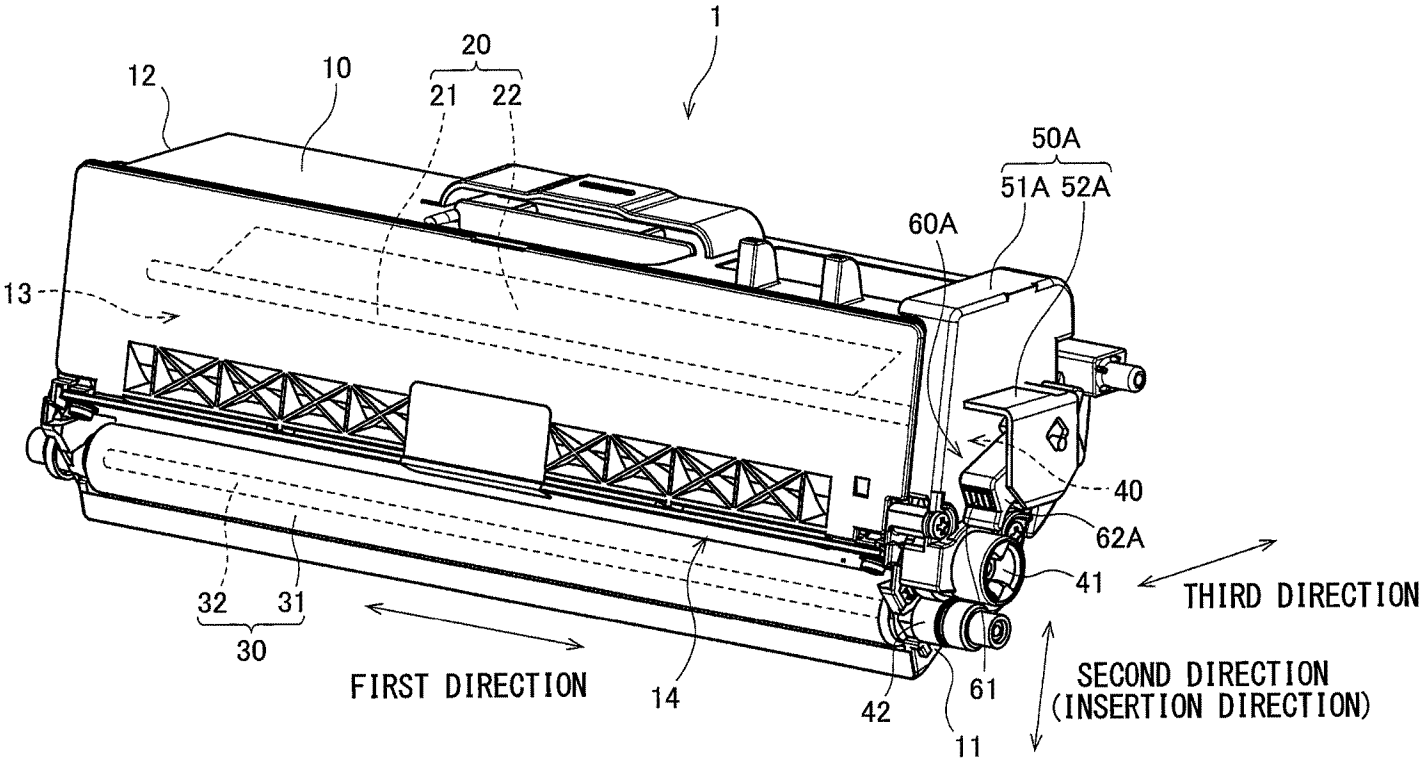
FIG. 9 is a perspective view of a developing cartridge according to a second embodiment.
Figure 10:
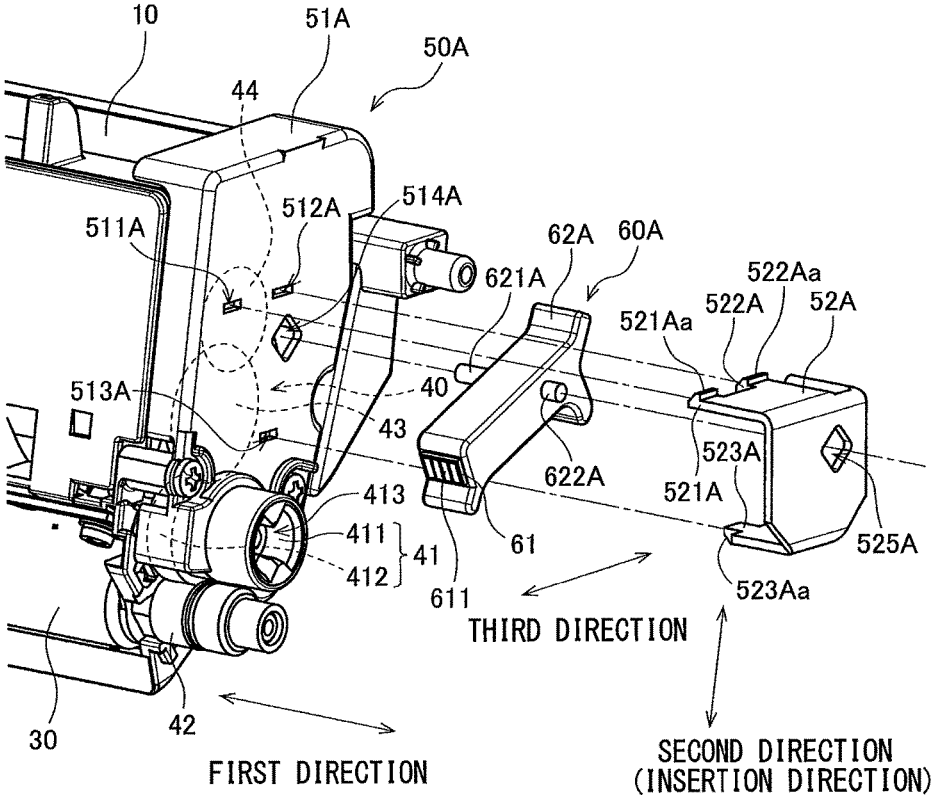
FIG. 10 is a partially exploded perspective view of the developing cartridge according to the second embodiment.

FIG. 9 is a perspective view of the developing cartridge 1 of the second embodiment. FIG. 10 is a partially exploded perspective view of the developing cartridge 1. As illustrated in FIG. 9, the developing cartridge 1 of the second embodiment includes a casing 10, an agitator 20, a developing roller 30, a gear unit 40, a cover 50A, and an IC chip assembly 60A. Since the configurations of the casing 10, the agitator 20, the developing roller 30, and the gear unit 40 are the same as those of the first embodiment, the repeated description will be omitted.

The cover 50A includes a gear cover 51A and a holder cover 52A. The gear cover 51A is fixed to the first end surface 11 of the casing 10 by, for example, screwing. At least a portion of the gear unit 40 is positioned between the first end surface 11 of the casing 10 and the gear cover 51A. The holder cover 52A is fixed to the gear cover 51A. The gear cover 51A has a first engagement hole 511A, a second engagement hole 512A, a third engagement hole 513A, and a first through-hole 514A. The first engagement hole 511A, the second engagement hole 512A, the third engagement hole 513A, and the first through-hole 514A penetrate the gear cover 51A in the first direction.

The holder cover 52A includes a first arm portion 521A, a second arm portion 522A, a third arm portion 523A, and a second through-hole 525A. The first arm portion 521A, the second arm portion 522A, and the third arm portion 523A extend from the holder cover 52A toward the gear cover 51A in the first direction. A first claw 521Aa protruding in a direction intersecting with the first direction is positioned at the tip of the first arm portion 521A. A second claw 522Aa protruding in a direction intersecting with the first direction is positioned at the tip of the second arm portion 522A. A third claw 523Aa protruding in a direction intersecting with the first direction is positioned at the tip of the third arm portion 523A. The second through-hole 525A penetrates the holder cover 52A in the first direction.

The first claw 521Aa engages with the first engagement hole 511A. The second claw 522Aa engages with the second engagement hole 512A. The third claw 523Aa engages with the third engagement hole 513A. Thus, the holder cover 52A is fixed to the gear cover 51A. That is, the holder cover 52A is fixed to the first end surface 11 of the casing 10A via the gear cover 51A.

However, the gear cover 51A and the holder cover 52A may be formed of a single member.

The IC chip assembly 60A is a unit including an IC chip 61 which is an example of a storage medium. The IC chip assembly 60 is positioned at one end of the casing 10 in the first direction. At least a portion of the IC chip assembly 60A is positioned between the gear cover 51A and the holder cover 52A. In a case where the developing cartridge 1 is inserted into the drawer unit 90, the IC chip assembly 60A is inserted between the first guide plate 91A and the second guide plate 92A.

As illustrated in FIGS. 9 and 10, the IC chip assembly 60A includes an IC chip 61 and a holder 62A. As in the first embodiment, the IC chip 61 includes an electric contact surface 611.

Figure 11:
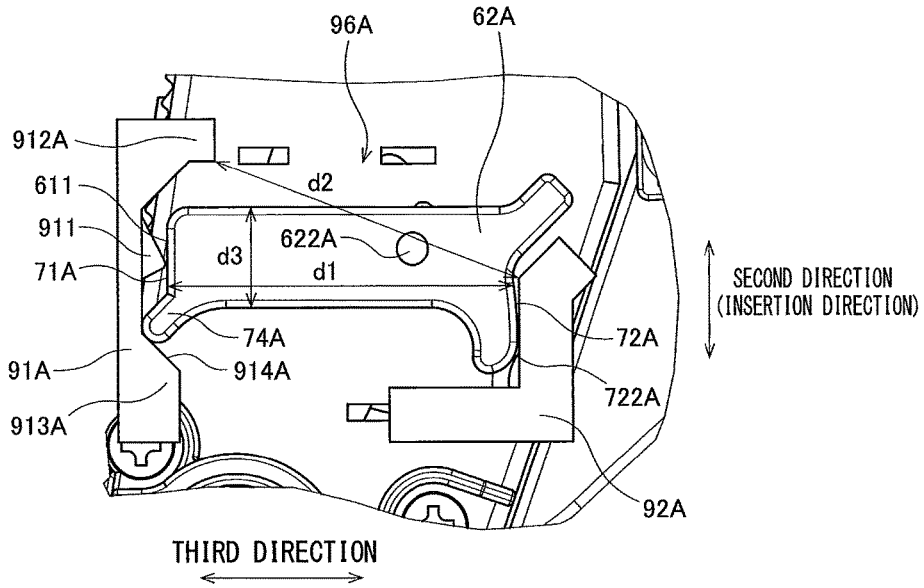
FIG. 11 illustrates an IC chip assembly after attaching the IC chip assembly to a drawer unit according to the second embodiment.

FIG. 11 is a view illustrating the IC chip assembly 60A after the IC chip assembly 60A is attached to the drawer unit 90. As illustrated in FIG. 11, the holder 62A includes a first outer surface 71A and a second outer surface 72A. The first outer surface 71A is positioned at one end of the holder 62A in the third direction. The second outer surface 72A is positioned at the other end portion of the holder 62A in the third direction. The first outer surface 71A and the second outer surface 72A are separated from each other in the third direction. The IC chip 61 is held on the first outer surface 71A. For example, the IC chip 61 is fitted into a recess positioned at the first outer surface 71A. However, the IC chip 61 may be fixed to the first outer surface 71A with an adhesive. The holder 62A and the electric contact surface 611 of the IC chip 61 are movable together. The holder 62A is integrally formed of, for example, a resin. The distance d1 in the third direction between the first outer surface 71A and the second outer surface 72A is a fixed distance.

The holder 62A includes a first boss 621A and a second boss 622A. The first boss 621A protrudes from the surface of the holder 62A facing the gear cover 51A toward the gear cover 51A in the first direction. The shape of the first boss 621A may be a cylinder or a polygonal column. The second boss 622A protrudes from the surface of the holder 62A facing the holder cover 52A toward the holder cover 52A in the first direction. The shape of the second boss 622A may be a cylinder or a polygonal column. The first boss 621A is inserted into the first through-hole 514A of the gear cover 51A. The second boss 622A is inserted into the second through-hole 525A of the holder cover 52A.

The size (inner dimension) of the first through-hole 514A in the second direction is greater than the size (outer dimension) of the first boss 621A in the second direction. Therefore, the first boss 621A is movable in the second direction relative to the gear cover 51A. In addition, the size (inner dimension) of the second through-hole 525A in the second direction is greater than the size (outer dimension) of the second boss 622A in the second direction. Therefore, the second boss 622A is movable in the second direction with respect to the holder cover 52A. Therefore, the holder 62A is movable in the second direction relative to the casing 10 and the cover 50A. In a case where the holder 62A moves in the second direction, the IC chip 61 having the electric contact surface 611 also moves in the second direction together with the holder 62A.

The size (inner dimension) of the first through-hole 514A in the third direction is greater than the size (outer dimension) of the first boss 621A in the third direction. Therefore, the first boss 621A is movable in the third direction relative to the gear cover 51A. Further, the size (inner dimension) of the second through-hole 525A in the third direction is greater than the size (outer dimension) of the second boss 622A in the third direction. Therefore, the second boss 622A is movable in the third direction relative to the holder cover 52A. Therefore, the holder 62A is movable in the third direction relative to the casing 10 and the cover 50A. In a case where the holder 62A moves in the third direction, the IC chip 61 having the electric contact surface 611 also moves in the third direction together with the holder 62A.

Further, the holder 62A may be movable in the first direction between the gear cover 51A and the holder cover 52A.

The second outer surface 72A includes a guide surface 722A. The guide surface 722A is positioned closer to the developing roller 30 than the electric contact surface 611 of the IC chip 61 is to the developing roller 30 in the second direction. The guide surface 722A is an inclined surface inclined relative to the second direction to approach the first outer surface 71A toward the developing roller 30. In a case where the developing cartridge 1 is inserted into the drawer unit 90, the guide surface 722A contacts with the second guide plate 92A. Thus, the position of the holder 62A to the casing 10 in the third direction changes. Specifically, the holder 62A moves toward the first guide plate 91A in the third direction. Detailed movement of the holder 62A at the time of insertion of the developing cartridge 1 will be described later.

Further, the holder 62A includes an engaging portion 74A. The engaging portion 74A is positioned farther from the second outer surface 72A than the first outer surface 71A is from the second outer surface 72A in the third direction. Further, the engaging portion 74A is positioned closer to the developing roller 30 than the electric contact surface 611 of the IC chip 61 is to the developing roller 30 in the second direction. The engaging portion 74A of the present embodiment is a protrusion. The engaging portion 74A protrudes from the first outer surface 71A toward the second direction and the third direction, in a direction away from the second outer surface 72A. The tip of the engaging portion 74A contacts with the first guide plate 91A. The tip surface of the engaging portion 74A is a stopper surface that contacts with the first guide plate 91A in the second direction.

In the present embodiment, the first outer surface 71A, the second outer surface 72A, and the engaging portion 74A are at the same position in the first direction. In this way, the thickness of the holder 62A in the first direction can be reduced. However, some parts of the first outer surface 71A, the second outer surface 72A, and the engaging portion 74A may be positioned at different positions in the first direction.

<2-2. Inserting Operation>

As illustrated in FIG. 11, the drawer unit 90 includes a first guide plate 91A and a second guide plate 92A. The first guide plate 91A and the second guide plate 92A face each other at an interval in the third direction. The first guide plate 91A includes an electrical connector 911. The electrical connector 911 protrudes from the surface of the first guide plate 91A toward the second guide plate 92A in the third direction. The electrical connector 911 is electrically connected to the control unit in the image forming apparatus.

Further, the first guide plate 91A includes a first guide protrusion 912A and a second guide protrusion 913A. The first guide protrusion 912A is positioned farther from the photosensitive drum 93 than the electrical connector 911A is from the photosensitive drum 93 in the second direction. The first guide protrusion 912A protrudes from the surface of the first guide plate 91A toward the second guide plate 92A. The drawer unit 90 includes an insertion opening 96A into which the holder 62A is inserted between the first guide protrusion 912A and the second guide plate 92A.

The second guide protrusion 913A is positioned closer to the photosensitive drum 93 than the electrical connector 911 is to the photosensitive drum 93 in the second direction. The second guide protrusion 913A protrudes from the surface of the first guide plate 91A toward the second guide plate 92A. Further, the second guide protrusion 913A includes an inclined surface 914A. The position of the inclined surface 914A in the third direction gradually approaches the second guide plate 92A as approaching the photosensitive drum 93.

Figure 12:
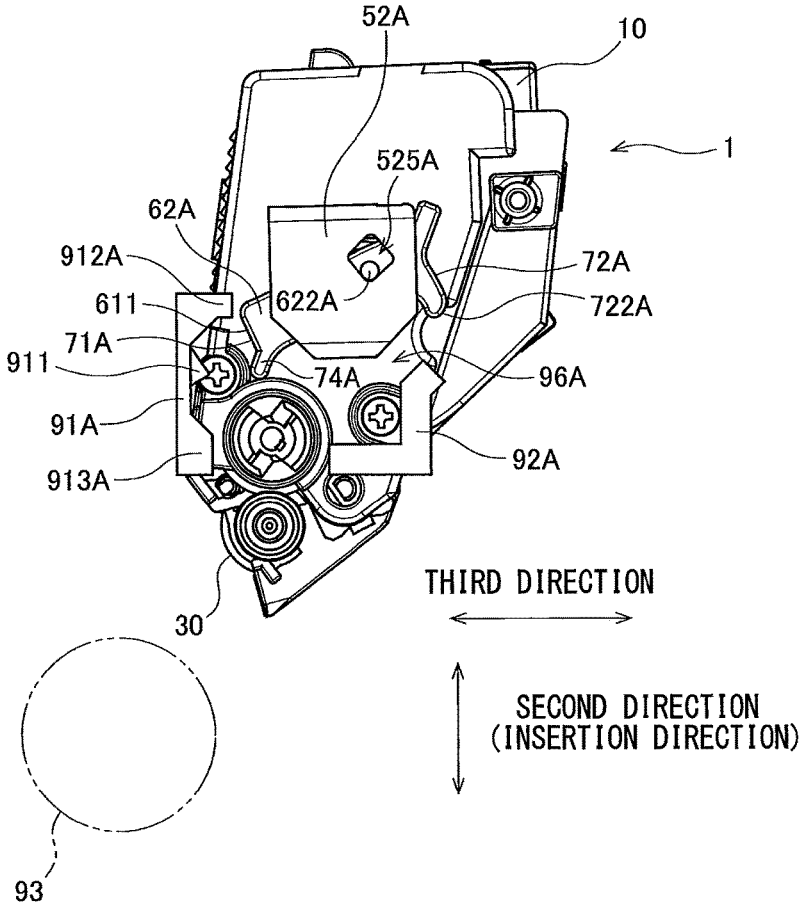
FIG. 12 illustrates an inserting operation according to the second embodiment.
Figure 13:
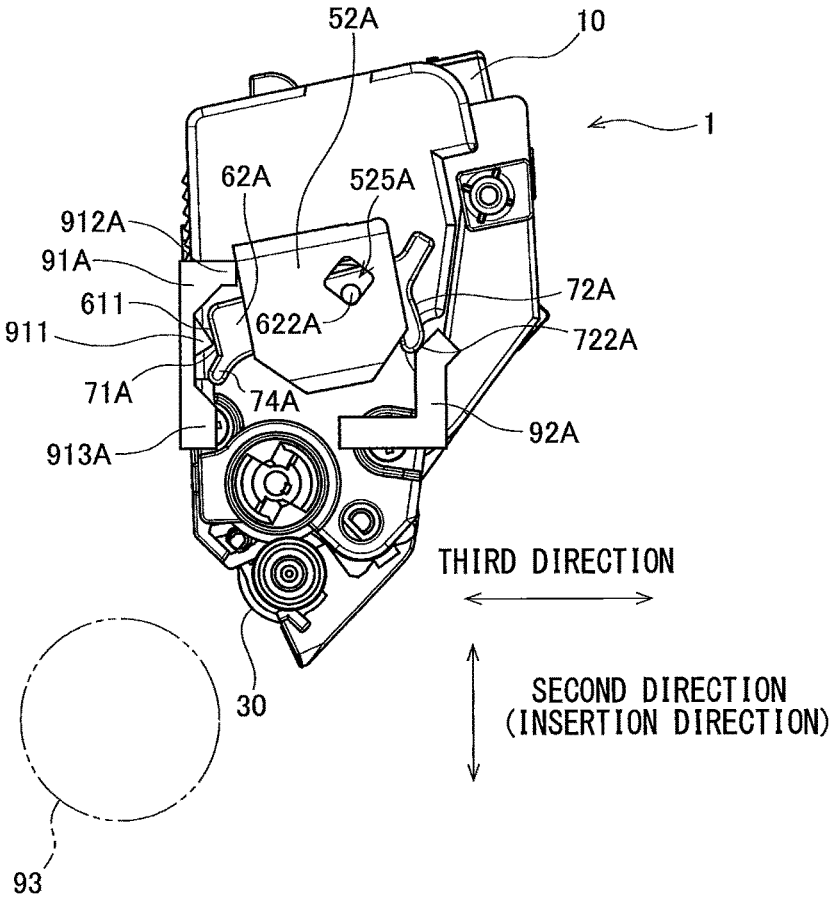
FIG. 13 illustrates the inserting operation according to the second embodiment.
Figure 14:
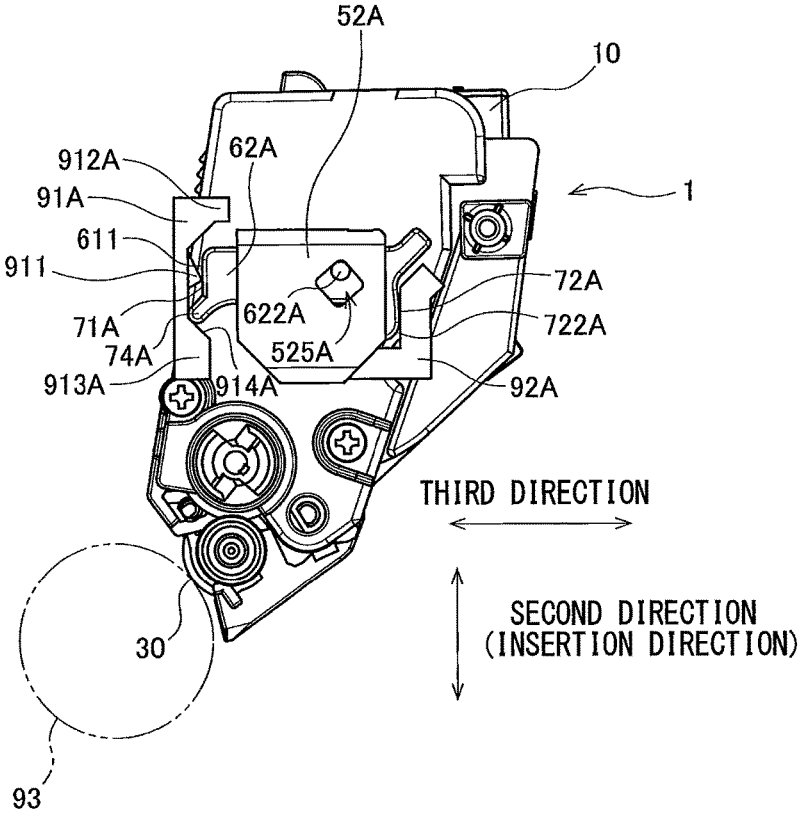
FIG. 14 illustrates the inserting operation according to the second embodiment.

FIGS. 12 to 14 are diagrams illustrating a state where the developing cartridge 1 is inserted into the drawer unit 90. In a case where the developing cartridge 1 is attached to the drawer unit 90, first, as illustrated in FIG. 12, the developing cartridge 1 is positioned at the first position with respect to the drawer unit 90. At the first position, the engaging portion 74A does not contact with the first guide plate 91A yet. In addition, the guide surface 722A does not contact with the second guide plate 92A yet. Further, the electric contact surface 611 of the IC chip 61 does not contact with the electrical connector 911 yet.

As illustrated in FIG. 11, in the present embodiment, the width d2 of the insertion opening 96A in the third direction (a length in the third direction between the top of the first guide protrusion 912A of the first guide plate 91A and the second guide plate 92A) is smaller than the length d1 of the holder 62A in the third direction (a length in the third direction between the first outer surface 71A and the second outer surface 72A of the holder 62A). Therefore, the holder 62A cannot pass through the insertion opening 96A while the first outer surface 71A and the second outer surface 72A are aligned in the third direction. However, the width d2 of the insertion opening 96A in the third direction is greater than the length d3 of the holder 62A in the second direction. Further, the holder 62A can be inclined about the first boss 621A and the second boss 622A relative to the casing 10 and the cover 50A. Therefore, as illustrated in FIG. 12, the holder 62A can pass through the insertion opening 96A in the second direction, while the holder 62A is inclined about the first boss 621A and the second boss 622A.

Subsequently, as illustrated in FIG. 13, the developing cartridge 1 is positioned at the second position relative to the drawer unit 90. At the second position, the engaging portion 74A does not contact with the first guide plate 91A yet, and the electric contact surface 611 of the IC chip 61 does not contact with the electrical connector 911 yet.

At the second position, the guide surface 722A of the holder 62A contacts with the second guide plate 92A. In a case where the developing cartridge 1 is further inserted from the second position toward the photosensitive drum 93, the holder 62A also receives a pressure in the second direction from the holder cover 52A toward the photosensitive drum 93. At this time, due to the contact between the guide surface 722A and the second guide plate 92A, the position of the holder 62A to the casing 10 in the third direction changes. Specifically, the holder 62A moves toward the first guide plate 91A in the third direction.

As a result, as illustrated in FIG. 14, the developing cartridge 1 is positioned at the third position with respect to the drawer unit 90. In a case where the developing cartridge 1 moves from the second position to the third position, the electric contact surface 611 first contacts with the electrical connector 911. At this time, the engaging portion 74A may not contact with the first guide plate 91A yet. After the electric contact surface 611 contacts with the electrical connector 911, the engaging portion 74A contacts with the first guide plate 91.

At the third position, the tip of the engaging portion 74A contacts with the inclined surface 914A of the first guide plate 91A. As a result, the movement of the first outer surface 71A to the first guide plate 91A in the second direction is stopped. In a case where the casing 10 is further pressed toward the photosensitive drum 93, the second outer surface 72A is also fitted between the first guide plate 91A and the second guide plate 92A. As a result, the first outer surface 71A and the second outer surface 72A of the holder 62A are aligned in the third direction. Further, in a case where the engaging portion 74A contacts with the inclined surface 914A, and as the second outer surface 72A including the guide surface 722A contacts with the second guide plate 92A, the holder 62A engages with the drawer unit 90. As a result, the position of the holder 62A to the drawer unit 90 in the third direction is fixed.

Further, at the third position, the electric contact surface 611 of the IC chip 61 contacts with the electrical connector 911. Thus, the control unit of the image forming apparatus can perform at least one of reading of information from the IC chip 61 and writing of information to the IC chip 61.

In this way, in the present embodiment, in a case where the developing cartridge 1 is inserted into the drawer unit 90, the guide surface 722A of the holder 62A contacts with the second guide plate 92A which is a portion of the image forming apparatus. As a result, the holder 62A moves in the third direction relative to the casing 10. As a result, the electric contact surface 611 of the IC chip 61 contacts with the electrical connector 911. As a result, the developing cartridge 1 can be inserted into the drawer unit 90, while suppressing the rubbing of the electric contact surface 611.

<2-3. Pivoting Operation>

Subsequently, the pivoting operation of the casing 10 after inserting the developing cartridge 1 into the drawer unit 90 will be described.

After inserting the developing cartridge 1 into the drawer unit 90, the casing 10 and the cover 50A pivot about the developing roller 30 relative to the drawer unit 90. Specifically, the casing 10 is inclined relative to the drawer unit 90 in the third direction. At this time, the protrusion 15 of the casing 10 contacts with the pressing member 94 of the drawer unit 90. The pressing member 94 presses the protrusion 15 toward the photosensitive drum 93. As a result, the developing roller 30 is pressed against the photosensitive drum 93. That is, the developing roller 30 and the photosensitive drum 93 are kept in a state where the developing roller 30 and the photosensitive drum 93 contact with each other.

Before and after the pivoting operation, the engaging portion 74A of the holder 62A is kept in contact with the first guide plate 91A. Further, before and after the pivoting operation, the second outer surface 72A of the holder 62A is kept in contact with the second guide plate 92A. Thus, the position of the holder 62A with respect to the drawer unit 90 does not change. Therefore, the electrical connector 911 and the electric contact surface 611 are kept in contact with each other. As a result, the rubbing of the electric contact surface 611 at the time of the pivoting operation is reduced. The first boss 621A of the holder 62A moves inside the first through-hole 514A in the third direction. Further, the second boss 622A of the holder 62A moves inside the second through-hole 525A in the third direction. Accordingly, the casing 10 and the cover 50A can move relative to the holder 62A in the third direction.

In a state after rotation, it is preferable that the holder cover 52A and the first boss 621A are not in contact with each other. Further, in the state after rotation, the holder cover 52A and the second boss 622A are preferably in a non-contact state. In a case where each of the first boss 621A and the second boss 622A are out of contact from the holder cover 52A, the holder 62A does not contact with the casing 10 and the cover 50A. Therefore, during the execution of the printing process in the image forming apparatus, the vibration is less likely to be transmitted from the driving unit such as the gear unit 40 to the IC chip assembly 60A. Thus, the contact state between the electric contact surface 611 and the electrical connector 911 can be more satisfactorily maintained.

<2-4. Separating Operation>

Figure 15:
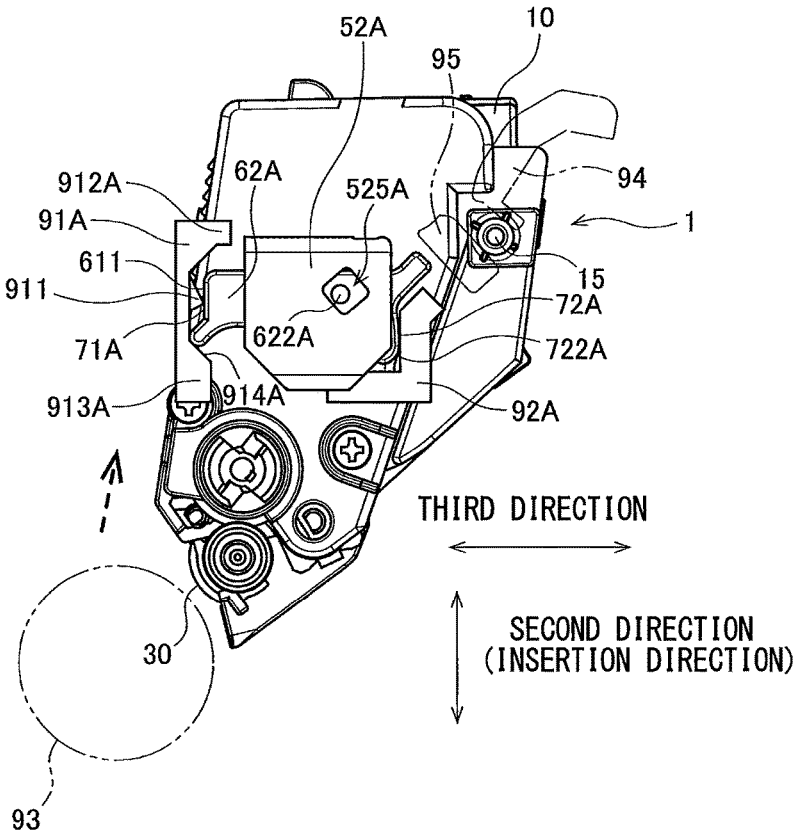
FIG. 15 illustrates a separating operation according to the second embodiment.

Subsequently, the separating operation after completion of the inserting operation and the pivoting operation will be described. FIG. 15 is a diagram illustrating a state where the separating operation is executed.

At the time of the separating operation, a lever (not illustrated) of the drawer unit 90 is pushed by the driving force from the image forming apparatus. Then, the separating member 95 of the drawer unit 90 moves toward the pressing member 94 in the second direction. As a result, the separating member 95 contacts with the protrusion 15 and presses the protrusion 15 in a direction away from the photosensitive drum 93 against the pressure of the pressing member 94. As a result, the casing 10, the developing roller 30, and the cover 50A of the developing cartridge 1 move in the second direction as indicated by broken line arrows in FIG. 15. Thus, the developing roller 30 and the photosensitive drum 93 are separated from each other.

Before and after the separating operation, the engaging portion 74A of the holder 62A contacts with the first guide plate 91A. Further, before and after the separating operation, the second outer surface 72A of the holder 62A contacts with the second guide plate 92A. Therefore, the position of the holder 62A with respect to the drawer unit 90 does not change. Therefore, the electrical connector 911 and the electric contact surface 611 contact with each other. In this state, since the protrusion 15 moves, the casing 10 and the developing roller 30 move relative to the photosensitive drum 93. Further, since the electrical connector 911 and the electric contact surface 611 are kept in contact with each other, rubbing of the electric contact surface 611 during the separating operation is reduced. The first boss 621A of the holder 62A moves inside the first through-hole 514A in the second direction. Further, the second boss 622A of the holder 62A moves inside the second through-hole 525A in the second direction. Thus, the casing 10 and the cover 50A are movable in the second direction relative to the holder 62A.

In the present embodiment, the direction of insertion of the developing cartridge 1 into the drawer unit 90 and the direction (separation direction) in which the developing roller 30 separates from the photosensitive drum 93 during the separating operation are both in the second direction. However, the insertion direction and the separation direction may be different directions. Each of the insertion direction and the separation direction may be a direction intersecting with the first direction.

3. Modified Example

Although the first and second embodiments of the present disclosure have been described above, the present disclosure is not limited to the above-described embodiments.

In the above embodiment, the IC chip having the electric contact surface is fixed to the first outer surface of the holder. However, only the electric contact surface that can contact with the terminal portion may be fixed to the first outer surface of the holder, and the portions other than the electric contact surface of the IC chip may be positioned at another portion of the developing cartridge.

Also, the first direction and the second direction may not be orthogonal to each other. Also, the second direction and the third direction may not be orthogonal to each other. Also, the first direction and the third direction may not be orthogonal to each other.

Further, in the above embodiment, a plurality of gears in the gear unit engage with each other by meshing of gear teeth with each other. However, the plurality of gears in the gear unit may engage with each other by frictional force. For example, instead of a plurality of gear teeth, a friction member (for example, rubber) may be positioned at the outer circumferential portion of the two gears engaging with each other.

The detail shapes of the developing cartridge may be different from the shapes illustrated in each figure in the application. Further, the elements in the embodiments or the modifications may be appropriately combined without leading to inconsistency.

What is claimed is:

1. A developing cartridge configured to be attached to an image forming apparatus, the developing cartridge being movable relative to the image forming apparatus from a first position to a second position and further from the second position to a third position in a case where the developing cartridge is attached to the image forming apparatus, the developing cartridge comprising:

a casing configured to store therein developer;

a developing roller rotatable about a first axis extending in a first direction, the developing roller being positioned at one end portion of the casing in a second direction crossing the first direction;

a storage medium having an electric contact surface, the electric contact surface being out of contact with an electric connector of the image forming apparatus in a case where the developing cartridge is at the first position and the second position, the electric contact surface contacting with the electric connector in a case where the developing cartridge is at the third position; and a holder positioned at one end of the casing in the first direction, the holder being movable relative to the casing in a third direction crossing the electric contact surface, the holder including:

a first outer surface positioned at one end of the holder in the third direction and holding the electric contact surface; and a second outer surface positioned at another end of the holder in the third direction, a distance between the first outer surface and the second outer surface in the third direction being a fixed distance, the second outer surface having a guide surface out of contact with a portion of the image forming apparatus in a case where the developing cartridge is at the first position, the guide surface contacting with the portion of the image forming apparatus in a case where the developing cartridge is at the second position, the guide surface being configured to guide movement of the holder relative to the casing in the third direction in a state where the guide surface contacts with the portion of the image forming apparatus; and an engaging portion configured to allow the holder to engage with the image forming apparatus in a state where the electric contact surface contacts with the electric connector in a case where the developing cartridge is at the third position.

2. The developing cartridge according to claim 1, wherein the engaging portion is configured to be disengaged from the image forming apparatus in a case where the developing cartridge is at the first position and at the second position.

3. The developing cartridge according to claim 1, wherein the guide surface is positioned farther from the developing roller than the electric contact surface is from the developing roller in the second direction.

4. The developing cartridge according to claim 3, wherein the engaging portion is a hook configured to hook the holder to the image forming apparatus.

5. The developing cartridge according to claim 1, wherein the engaging portion is a groove to fit the holder to the image forming apparatus.

6. The developing cartridge according to claim 1, wherein the engaging portion further includes a stopper surface configured to contact with the image forming apparatus in the second direction in a case where the developing cartridge is at the third position.

7. The developing cartridge according to claim 1, wherein the engaging portion is positioned farther from the developing roller than the guide surface is from the developing roller in the second direction.

8. The developing cartridge according to claim 1, wherein the engaging portion is positioned at the first outer surface.

9. The developing cartridge according to claim 8, wherein the engaging portion and the guide surface allow the holder to engage with the image forming apparatus in a state where the electric contact surface contacts with the electric connector in a case where the developing cartridge is at the third position.

10. The developing cartridge according to claim 8, wherein the engaging portion further includes a stopper surface configured to contact with the image forming apparatus in a case where the developing cartridge is at the third position.

11. The developing cartridge according to claim 8, wherein the engaging portion includes a stopper surface configured to contact with the image forming apparatus in the second direction in a case where the developing cartridge is at the third position.

12. The developing cartridge according to claim 1, further comprising a holder cover fixed to an outer surface of the casing, the outer surface being positioned at the one end of the casing in the first direction;

wherein one of the holder and the holder cover includes a boss extending in the first direction;

wherein remaining one of the holder and the holder cover includes one of a through-hole and a recessed portion into which the boss is inserted, the one of the through-hole and the recessed portion having a size in the third direction greater than a size of the boss in the third direction; and wherein the holder is movable in the third direction relative to the holder cover and the casing in a state where the boss is inserted into the one of the through-hole and the recessed portion.

13. The developing cartridge according to claim 12, wherein the image forming apparatus has an insertion opening through which the holder is inserted in the second direction, wherein a size of the insertion opening in the third direction is smaller than a size of the holder in the third direction, a size of the insertion opening in the second direction being greater than a size of the holder in the second direction; and wherein the holder is configured to be inclined relative to the boss.

14. The developing cartridge according to claim 1, wherein the casing is movable in the second direction relative to the holder in a state where the engaging portion allows the developing cartridge to engage with the image forming apparatus in a case where the developing cartridge is at the third position.

15. The developing cartridge according to claim 14, further comprising a holder cover fixed to an outer surface of the casing, the outer surface being positioned at the one end of the casing in the first direction;

wherein one of the holder and the holder cover includes a boss extending in the first direction;

wherein remaining one of the holder and the holder cover has one of a through-hole and a recessed portion into which the boss is inserted;

wherein a size of one of the through-hole and the recessed portion in the second direction is greater than a size of the boss in the second direction;

wherein a size of one of the through-hole and the recessed portion in the third direction is greater than a size of the boss in the third direction;

wherein the holder is movable in the second direction relative to the holder cover and the casing in a state where the boss is inserted into one of the through-hole and the recessed portion; and wherein the holder is movable in the third direction relative to the holder cover and the casing in a state where the boss is inserted into the one of the through-hole and the recessed portion.

16. The developing cartridge according to claim 1, wherein the engaging portion is configured to engage with the image forming apparatus after the electric contact surface contacts with the electric connector in a case where the developing cartridge moves from the second position to the third position.

17. The developing cartridge according to claim 1, wherein the storage medium is movable together with the electric contact surface.

* * * * *